US009716332B1

(12) United States Patent
Wimmer et al.

(10) Patent No.: US 9,716,332 B1
(45) Date of Patent: Jul. 25, 2017

(54) CONTACT PART

(71) Applicant: Lisa Draexlmaier GmbH, Vilsbiburg (DE)

(72) Inventors: Stefan Wimmer, Hohenthann (DE); Robert Saller, Egglkofen (DE); Christian Wimmer, Gerzen (DE)

(73) Assignee: Lisa Draexlmaier GmbH, Vilsbiburg (DE)

( * ) Notice: Subject to any disclaimer, the term of this patent is extended or adjusted under 35 U.S.C. 154(b) by 0 days.

(21) Appl. No.: 15/415,093

(22) Filed: Jan. 25, 2017

(30) Foreign Application Priority Data

Jan. 26, 2016 (DE) ..... 10 2016 201 103

(51) Int. Cl.
*H01R 13/187* (2006.01)
*H01R 13/11* (2006.01)
*H01R 13/03* (2006.01)

(52) U.S. Cl.
CPC ..... *H01R 13/113* (2013.01); *H01R 13/03* (2013.01); *H01R 13/187* (2013.01)

(58) Field of Classification Search
CPC ..... H01R 13/03; H01R 13/04; H01R 13/05; H01R 13/10; H01R 13/113; H01R 13/187
USPC ..... 439/817, 843, 845, 849, 850
See application file for complete search history.

(56) References Cited

U.S. PATENT DOCUMENTS 4,472,017 A * 9/1984 Sian ..... H01R 13/113 439/747
4,534,610 A * 8/1985 Takihara ..... H01R 13/187 439/712
4,753,616 A * 6/1988 Molitor ..... H01R 13/187 439/787
4,979,915 A * 12/1990 Pitts ..... H01R 13/04 439/595
5,199,909 A * 4/1993 Molitor ..... H01R 13/113 439/651

(Continued)

FOREIGN PATENT DOCUMENTS

CH 702 863 A1 9/2011
DE 10 2012 002 145 A1 8/2013

(Continued)

OTHER PUBLICATIONS

Office Action in German Application No. DE 10 2016 201 103.0, dated Oct. 5, 2016.

*Primary Examiner* — Tulsidas C Patel
*Assistant Examiner* — Travis Chambers
(74) *Attorney, Agent, or Firm* — Finnegan, Henderson, Farabow, Garrett & Dunner LLP

(57) ABSTRACT

Embodiments disclose a contact part comprising a sleeve forming a receiving space for a plug-in contact to be inserted in an insertion direction; a contact spring secured to an inside of the sleeve, the contact spring comprising a first protrusion, a second protrusion and an intermediate section between the first and second protrusions; and a plate-shaped contact tab attached to the sleeve so as to form the receiving space between the contact tab and the contact spring, the contact tab comprising a profile oriented towards the contact spring, the profile having a flat portion extending towards the intermediate section of the contact spring. Applications for the present disclosure include high-current plug connections, such as those used in vehicles and onboard wiring systems.

20 Claims, 2 Drawing Sheets

(56) References Cited

U.S. PATENT DOCUMENTS 5,441,428 A 8/1995 Hamai et al.
5,645,459 A * 7/1997 Fitting ..... H01R 13/11 439/852
5,679,034 A * 10/1997 Hanazaki ..... H01R 13/187 439/845
5,746,620 A * 5/1998 Clark ..... H01R 4/2429 439/404
5,810,627 A * 9/1998 Gierut ..... H01R 13/187 439/843
5,938,485 A * 8/1999 Hotea ..... H01R 13/18 439/839
6,743,036 B2 * 6/2004 Lauter ..... H01J 5/52 349/152
7,011,548 B2 * 3/2006 Bogiel ..... H01R 12/727 439/247
7,736,194 B1 * 6/2010 Chang ..... H01R 13/111 439/578
7,775,840 B2 * 8/2010 Matsumoto ..... H01R 13/113 439/843
7,845,993 B2 * 12/2010 Falchetti ..... H01R 13/113 439/843
8,419,486 B2 * 4/2013 Tyler ..... H01R 13/113 439/842
8,616,925 B2 * 12/2013 Kobayashi ..... H01R 13/113 439/845
8,668,531 B2 * 3/2014 Yamaguchi ..... H01R 13/187 439/843
2001/0024912 A1 * 9/2001 Sato ..... H01R 13/114 439/843
2002/0123275 A1 * 9/2002 Zhao ..... H01R 13/187 439/851
2003/0073354 A1 * 4/2003 Hotea ..... H01R 13/18 439/843
2004/0116002 A1 * 6/2004 Rozet ..... H01R 13/187 439/843
2006/0014442 A1 * 1/2006 Allgood ..... H01R 11/289 439/843
2006/0252294 A1 * 11/2006 Cvasa ..... H01R 13/187 439/252
2007/0072494 A1 * 3/2007 Tyler ..... H01R 13/187 439/843
2008/0146091 A1 * 6/2008 Tyler ..... H01R 13/03 439/843
2009/0029605 A1 * 1/2009 Matsumoto ..... H01R 13/187 439/843
2016/0254610 A1 * 9/2016 Hirakawa ..... H01R 13/187
2016/0285178 A1 9/2016 Wimmer

FOREIGN PATENT DOCUMENTS

DE 10 2015 104 377 A1 9/2016
EP 2 840 661 A1 2/2015
JP H02-199780 A 8/1990
JP 2007/280729 A 10/2007
JP 2011-96392 5/2011
WO WO 2007/012883 A1 2/2007
WO WO 2012/176936 A1 12/2012

* cited by examiner

CONTACT PART

CROSS REFERENCE TO RELATED APPLICATIONS

This application is based upon and claims the benefit of prior German Patent Application No. 10 2016 201 103.0, filed on Jan. 26, 2016, the entire contents of which are incorporated herein by reference.

TECHNICAL FIELD

The present disclosure relates to a contact part comprising a sleeve that forms a receiving space on its inside for insertion of a plug-in contact. The present disclosure can be used in high-current plug connections, for example in vehicles and onboard wiring systems.

BACKGROUND

German patent document DE 10 2012 002 145 A1 discloses a sleeve contact for an electrical zero insertion force connector comprising a basic body forming a contact area for adding a complementary electrical plug-in contact. The sleeve contact also comprises a clamping sleeve which is arranged on the basic body for displacement relative to the basic body and which, in a sliding position for making contact with a plug-in contact inserted into the sleeve contact, exerts a contact force on the contact area of the sleeve contact. The clamping sleeve acts on a spring introduced into the basic body as an additional part. However, the sleeve contact suffers from various drawbacks. For example, the clamping sleeve hampers installation in a housing. It is especially difficult to establish compatibility of the installation space with existing plug connection geometries. Moreover, high vibration resistance is not ensured.

Other contact parts are also disclosed in JP 2007/280 729 A, U.S. Pat. No. 5,441,428 A, WO 2012/176936 A1, US 2002/0123275 A1 and JP H02-199780 A. However, the disclosed contact parts are not suitable for high-current contacts in the automotive sector with its stringent demands for withstanding vibrations and fluctuations in contact resistance.

German patent document DE 10 2015 104 377 A1 describes an electrical contact. However, a locking pin is required for the contact and the position of the contact tab in the sleeve creates an unwanted center of gravity in the lower contact area.

SUMMARY

Embodiments of the present disclosure provide a contact part comprising a sleeve forming a receiving space on its inside for a plug-in contact to be inserted in an insertion direction. One or more springs (hereinafter referred to as "contact spring(s)" without limiting the generality of the term) may be attached to the inside of the sleeve and a contact tab may be attached to the sleeve, thereby forming the receiving space between the contact tab and the contact spring. The contact spring may include two bulges (also referred to as "protrusions"), both oriented toward the contact tab. A profile formed in the contact tab and oriented toward the bulges may have a flattened plateau and extends between the crests of the bulges. The plateau and the bulges may be symmetrical to a shared imaginary axis perpendicular to an insertion direction of the plug-in contact. The profile may have a flat plateau (unlike the shape of the bulge) and cover at least one intermediate section between the two bulges.

According to embodiments of the present disclosure, no locking pin is necessary to secure the plug-in contact in the receiving space. The two bulges on the one side and the contact tab on the other side may generate sufficient pressing force to hold the plug-in contact in place. This contact part may be easier to produce and can be secured with no additional movement of a locking pin or the like, while providing a secure locked state that is suitable for application in automobiles. In some embodiments, the contact part is particularly suitable for smaller plug sizes in automobiles.

According to embodiments of the present disclosure, the required contact forces can be varied, for example, by altering the strength, shape and/or material of the contact spring(s).

According to embodiments of the present disclosure, the contact part may be a first contact part of an electrical plug connection. The plug connection comprises the mating second contact part or contact counterpart of the plug connection or a part thereof. The contact part may also be referred to as a "sleeve contact" or a "contact". The contact part may be a female contact part and the plug-in contact may be a male contact part. However, the contact part is not limited in this way, and in some embodiments the contact part may be a male contact part, a female contact part or a combination of the two.

According to embodiments of the present disclosure, the sleeve is open at least at the front side to permit the plug-in contact to be inserted from the front of the sleeve. The sleeve may also be open on two opposite sides (i.e. at the front and the back side of the sleeve). The sleeve may be laterally closed peripherally. The sleeve may also be referred to as a sleeve-shaped basic part, basic body, housing or cage. The sleeve may have a rectangular basic shape with rounded corners when viewed from the front (i.e. in the insertion direction).

According to embodiments of the present disclosure, to obtain a contact pressure that is uniform across the area of the plug-in contact, the two bulges in the contact spring may be symmetrical to an imaginary axis perpendicular to the insertion direction. Thus, the two bulges may hold the plug-in contact with uniform firmness.

According to embodiments of the present disclosure, the contact pressure may be higher when the bulges are pronounced, for example having a height that is a multiple of the thickness of the contact spring, such as a multiple factor of 3 to 10. At the same time a minimum distance may be defined between the plug-in contact and the side of the sleeve to which the contact spring is attached. The bulges may have the approximate shape of a sine half-wave, such that the exerted forces do not grow steadily when the plug-in contact is inserted, but rather are initially high and then increase only slightly. The sine wave can also be stepped.

According to embodiments of the present disclosure, the contact spring may be mounted in the sleeve by being suspended on tabs from both sides. To this end, a central recess may be provided for each of the two ends of the contact spring and two support areas each may be provided at the edge.

According to embodiments of the present disclosure, the sleeve is a formed metallic sheet metal part, for example a stamped and bent part. This can keep the manufacturing costs particularly low and allows higher mechanical strength.

According to embodiments of the present disclosure, the one or more contact springs is/are held in a positive and/or friction fit. Thus, the contact spring may be a component manufactured separately from the sleeve. The contact spring can be gripped to be held in a positive fit, for instance by bent areas at an end of the sleeve (corresponding to tabs, for example). In some embodiments, the contact spring may be applied to the sleeve and the sleeve can then be bent by areas onto the contact spring. Thus, the sleeve can be produced independently of the contact springs.

According to embodiments of the present disclosure, the one or more contact springs are made of steel such as stainless steel. In this way, a large contact force may be exerted on the plug-in contact, because of the high yield strength of steel (for example, in comparison to metals such as copper). As a result of the large contact force, it may also be possible to lower an electrical transition resistance between the plug-in contact and the contact part. For example, the electrical transition resistance may be lowered to a value that is practically insignificant.

According to embodiments of the present disclosure, the contact tab may have a profile facing the receiving space. This may define the distance of the plug-in contact from the side of the sleeve that accommodates the contact tab. In this way, a central arrangement of the plug-in contact becomes easier and the center of gravity of the sleeve is moved to the middle.

According to embodiments of the present disclosure, the profile may have a height amounting to a multiple of the thickness of the contact tab, for example by a factor of 2 to 4, to center the plug-in contact.

According to embodiments of the present disclosure, copper such as electrolytic copper or a copper alloy may be selected for the contact tab, and a contact surface of the contact tab at the profile may be silver-plated or, as an alternative, coated with gold, tin or zinc. This side of the contact may be optimized for a low electrical transition resistance, whereas the contact spring, for instance one made of stainless steel, may be optimized for durable contact pressure.

According to embodiments of the present disclosure, a receiving area can be formed along a plane stretching through the middle of the sleeve, parallel to an insertion direction of the plug-in contact, regardless of which side faces upwards and whether it is somewhat offset from the middle when inserted.

According to embodiments of the present disclosure, the sleeve may also be made of steel, for example stainless steel. In this way, chemical reactions between the contact spring and the sleeve can be avoided. Steel is also generally less expensive than copper, and may thus reduce manufacturing costs.

According to embodiments of the present disclosure, to connect the contact part (e.g., to a busbar or a cable) the sleeve may positively hold the plate-shaped contact tab and the receiving space for the plug-in contact may be located between the contact tab and the one or more contact springs.

According to embodiments of the present disclosure, for a positive attachment in the sleeve the contact tab may have laterally extending protrusions that engage in corresponding recesses in the sleeve or abut the sleeve as a stop. The engagement or abutment can be implemented, for example, by plastic forming, for example by bending a sheet-metal part to form the finished sleeve with the contact tab set upon it.

According to embodiments of the present disclosure, the sleeve has positively interlocking lateral edges. In this way, a mechanically robust sleeve that does not open may be provided by plastic forming. Welding or the like may thus not be necessary. The abutting edge of the sleeve may also be flat.

According to embodiments of the present disclosure, the two abutting edges may have complementary undercut edge contours, such as a meander-shaped edge.

The described properties of the present disclosure and the manner in which these are achieved will be described in more detail based on the following detailed description. The foregoing general description and the following detailed description are exemplary and explanatory only, and are not restrictive of embodiments consistent with the present disclosure. Further, the accompanying drawings illustrate embodiments of the present disclosure, and together with the description, serve to explain principles of the present disclosure.

DETAILED DESCRIPTION

Figure 1:
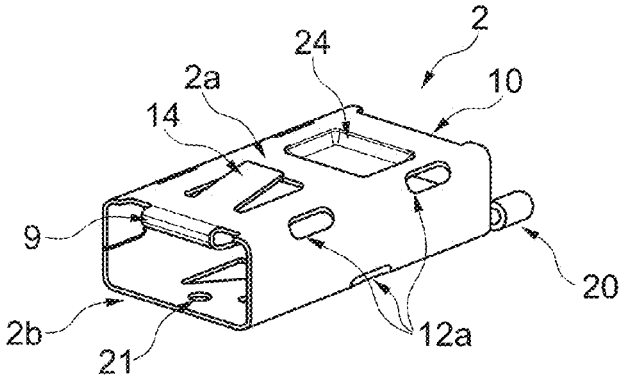
FIG. 1 shows a sleeve of an exemplary contact part.

FIG. 1 is a perspective view of a sleeve 2 of a contact part. The sleeve 2 is a bent stainless steel sheet in which one or two openings 12*a* are provided at the bending edges to facilitate the bending process. Detent tabs 14 are provided on the upper side 2*a* and the lower side 2*b* of the sleeve. With the aid of the detent tabs, the sleeve 2 may be primarily latched to a housing (not shown) that encloses the contact part 1 (shown in FIG. 4). The detent tabs 14 are resilient and bent slightly outward from the sleeve during the stamping and bending phase of the manufacturing process.

Figure 3:
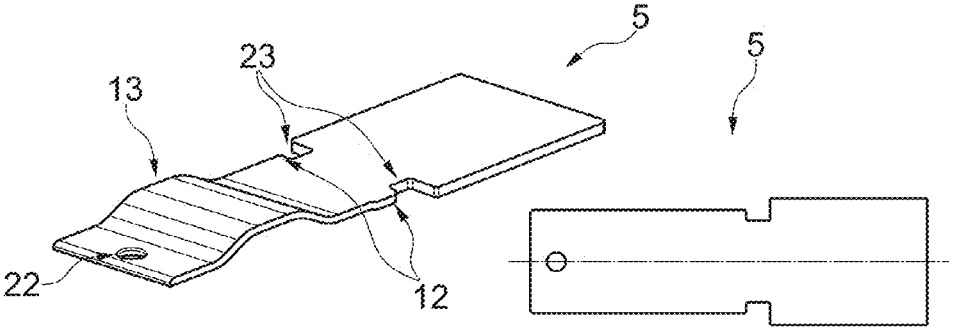
FIG. 3 shows a contact tab of an exemplary contact part.

To attach the sleeve 2 to a contact tab 5 illustrated in FIG. 3, the sleeve 2 includes a mounting hole 21. The mounting hole 21 is provided at the sleeve end through which a plug-in contact is to be inserted. The contact tab 5 may be attached to the sleeve 2 by a TOX® or welded joint. In addition, a mounting tab 20 is provided at the other end of the sleeve 2.

Inwardly bent tabs 9 and 10 provided at both ends of the sleeve 2 on the upper side 2*a* enable the attachment of a contact spring 3.

Figure 2:
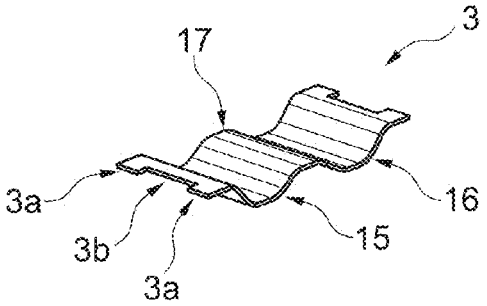
FIG. 2 shows a contact spring of an exemplary contact part.

The contact spring 3 is shown in FIG. 2. The contact spring is a flat stainless steel strip with a recess 3*b* between two support areas 3*a* that are provided on the two narrow sides of the contact spring 3 and that rest on the tabs 9, 10 of the sleeve 2. The contact spring 3 is arched and has two symmetrical bulges 15, 16 that protrude into the interior of the sleeve 2 when installed. Both bulges 15, 16 have a slightly stepped sinusoidal shape and are separated by an intermediate section 17. As a result the contact spring 3 is symmetrical in two axes (but not the axis perpendicular to the insertion direction, towards the upper side and/or lower side 2*a*, 2*b*), which rules out assembly errors.

The sleeve 2 and the contact spring 3 may be made of stainless steel, providing a robust and rigid structure compared to elements of the copper group, such as tin, zinc or aluminum. In this way, a large contact force can be achieved without plastic deformation of one of these components.

Figure 4:
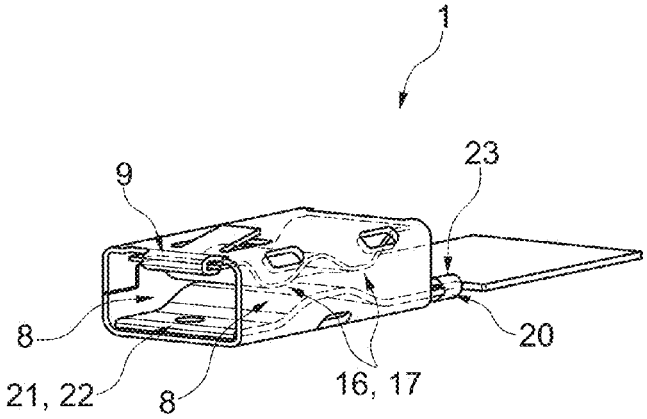
FIG. 4 shows the assembled sleeve, contact spring and contact tab.
Figure 5:
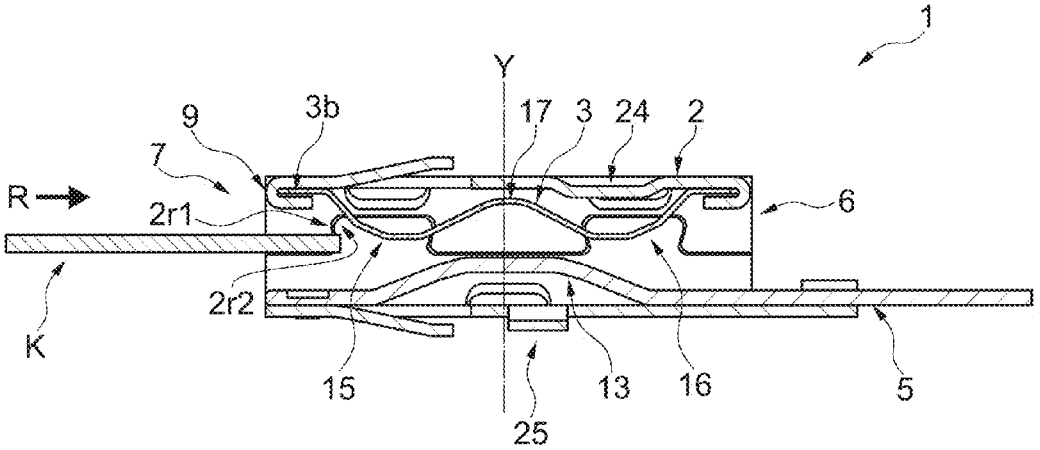
FIG. 5 is a side view of an exemplary contact part.

The contact tab 5 according to FIG. 3 is a plate-shaped, flat copper part with a profile 13 that has a flattened plateau. The profile 13 is oriented toward the bulges 15, 16 of contact spring 3 when installed (as shown in FIGS. 4 and 5). The profile 13 protrudes into the interior of the sleeve 2 when installed. To attach the contact tab 5 to the sleeve 2, a recess 23 is provided in both longitudinal sides to couple with the mounting tab 20 of the sleeve 2 when installed. The mounting tab 20 at one end of the sleeve 2 provides a bent structure around the contact tab 5 on both sides, at the particular recess 23. Protrusions 12 on each side of the contact tab 5 provide further support for coupling the contact tab 5 to the mounting tab 20 of sleeve 2. A mounting hole 22 that aligns with the mounting hole 21 of the sleeve 2 is provided at the other end of the contact tab 5 to establish a durable connection between the contact tab 5 and the sleeve 2. Depending on the mounting procedure selected at this end of the contact tab 5, other measures may also be taken as an alternative to the mounting hole 22 in order to establish a durable connection between the contact tab 5 and the sleeve 2. This attachment assists in handling the vibration shocks that occur when the contact part is being used in an automotive environment.

The contact tab 5 may consist of copper or a copper alloy. The contact tab 5 may be surface-treated, such as mechanically or chemically surface-treated. The surface treatment includes a silver coating in the area of the profile 13.

The interaction between the mounting holes 21, 22 and the mounting tab 20 with the profile 13 may be better appreciated in the installed state, after the sleeve 2, contact spring 3 and contact tab 5 have been assembled to form a contact part 1 (see FIG. 4). The attachment of the contact spring 3 to the tabs 9 and 10 of the sleeve 2 is also illustrated in FIG. 4.

The support areas 3*a*, 3*b* of the contact spring 3 are arranged to the right and the left of the tabs 9 and 10, and hold the contact spring 3 in place. The contact spring 3 may also be held in place with a friction fit if the tabs 9, 10 are bent over accordingly.

A receiving space 8 for a plug-in contact (shown in FIG. 5) is formed between the contact spring 3 and the contact tab 5. The receiving space 8 is positioned centrally between the upper side 2*a* and lower side 2*b* of the sleeve 2.

FIG. 5 shows the sleeve 2. The sleeve 2 is closed peripherally and has an open back side 6 and an open front side 7. The front side 7 is provided for insertion of the plug-in contact K, namely in an insertion direction indicated by R in FIG. 5. The insertion direction R extends on or parallel to a longitudinal axis of the sleeve 2. In a front view perpendicular to the insertion direction R, the sleeve 2 is basically rectangular with rounded corners. The sleeve 2 provides a receiving space 8 on its inside, for the plug-in contact K to be inserted in the insertion direction R.

As shown in FIG. 5, the sleeve 2 has positively interlocking side edges 2*r*1, 2*r*2. These edges are formed as a complementary meander, which results in a positive fit. This positive fit makes it unnecessary to apply welding, adhesive bonding, or the like to the side edges 2*r*1, 2*r*2, or it yields an especially rugged welded joint, bonded area, or the like. The side edges 2*r*1, 2*r*2 may be (but do not have to be) welded or adhered together. Since the contact tab 5 overlaps the side edges 2*r*1, 2*r*2 on the inside, they cannot be easily pressed apart.

In a longitudinal cut (along the insertion direction R) two bulges 15, 16 curve the contact spring 3 in such a way that it forms front and back pressure areas (caused by the bulges 15, 16) starting from the tabs 9 and/or 10 and extending in the direction of the plug-in contact K and the contact tab 5. The pressure areas are symmetrically arranged around an axis of symmetry Y. The axis of symmetry Y is centrally located in the contact part 1 and perpendicular to the insertion direction R.

The intermediate section 17 connecting the bulges 15, 16 is located in the same longitudinal position as the axis of symmetry Y and the center of the profile 13 of the contact tab 5 when installed. This results in a symmetrical arrangement of the contact spring 3 and the contact tab 5 around the axis of symmetry Y, which enables an optimal contact pressure at the plug-in contact K and makes a locking pin unnecessary. The centering of the plug-in contact K with 6.3 mm in width and the secure interlock are also aided by the contours of the bulges 15, 16 and of the profile 13. For example, the contact spring 3 (for example, 0.15 mm thick) is thinner than the contact tab 5 (for example, 0.4 mm thick), and the bulges have a height of approximately 5-6 times the thickness of the contact spring 3. The height of the profile 13 is approximately two times the thickness of the contact tab 5.

In FIG. 5 an undercut latch 25 is shown, which is part of the sleeve 2 and projects from the sleeve 2. The undercut latch 25 has sharp edges toward the front side 7 and the back side 6, and extends centrally with reference to the sleeve 2 across almost the entire width of the sleeve 2. The undercut latch 25 enables a secondary locking of the sleeve 2 and thus of the contact part 1 in a housing (which may be made of plastic) of the contact part 1, whereby it complements the primary locking by the detent tabs 14.

A square stiffening bead 24 may be provided, for example, at the upper side of the sleeve 2. The bead 24 may reinforce the sleeve 2 without interacting with the contact spring 3.

In general, by "a", "an", etc. a singular or plural may be understood, particularly in the sense of "at least one" or "one or more", etc., as long as this is not explicitly ruled out, for instance by the expression "exactly one" etc.

Also, a number can indicate precisely the given number or it can also include a customary tolerance range, as long as this is not expressly ruled out.

Having described aspects of the present disclosure in detail, it will be apparent that modifications and variations are possible without departing from the scope of aspects of the present disclosure as defined in the appended claims. As various changes could be made in the above constructions, products, and methods without departing from the scope of aspects of the present disclosure, it is intended that all matter contained in the above description and shown in the accompanying drawings shall be interpreted as illustrative and not in a limiting sense.

LIST OF REFERENCE NUMBERS

1 contact part
2 sleeve
2*a* upper side of sleeve 2
2*b* lower side of sleeve 2
2*r*1 side edge
2*r*2 side edge
3 contact spring
3*a* support area
3*b* recess
5 contact tab
6 open back side
7 open front side
8 receiving space
9, 10 tabs

12 protrusion in contact tab
12*a* openings
13 profile
14 detent tab
15, 16 bulge
17 intermediate section
20 mounting tab
21, 22 mounting holes
23 recess
24 stiffening bead
25 undercut latch
K plug-in contact
R insertion direction
Y axis of symmetry

What is claimed is:

1. A contact part, comprising:

a sleeve enclosing a receiving space to accommodate a plug-in contact;

a contact spring secured to an inside of the sleeve, the contact spring comprising a first protrusion, a second protrusion, and an intermediate section between the first and second protrusions; and a plate-shaped contact tab attached to the sleeve so as to form the receiving space between the contact tab and the contact spring, the contact tab comprising a profile oriented towards the contact spring, the profile having a flat portion extending towards the intermediate section of the contact spring.

2. The contact part according to claim 1, wherein:

the sleeve comprises tabs arranged at each end of the sleeve; and the contact spring is suspended in the sleeve from the tabs.

3. The contact part according to claim 1, wherein the sleeve is a formed sheet metal part holding the contact spring in at least one of a positive fit or a friction fit.

4. The contact part according to claim 1, wherein the contact spring comprises steel.

5. The contact part according to claim 1, wherein the contact tab comprises at least one of a copper tab or a silver-plated profile.

6. The contact part according to claim 1, wherein the receiving space is formed along a central plane through the sleeve, parallel to an insertion direction of the plug-in contact.

7. The contact part according to claim 1, wherein the sleeve comprises an upper side and a lower side, and the protrusions are symmetrical about an axis perpendicular to the lower side.

8. The contact part according to claim 7, wherein the protrusions comprise an approximate shape of at least a portion of a sine.

9. The contact part according to claim 7, wherein the sleeve comprises a square stiffening bead on the upper side of the sleeve, the stiffening bead being configured to reinforce the sleeve.

10. The contact part according to claim 7, wherein the sleeve comprises a first detent tab on the upper side of the sleeve and a second detent tab on the lower side of the sleeve, the first and second detent tabs being bent outwards from the sleeve.

11. The contact part according to claim 7, wherein the height of the protrusions is a multiple of the thickness of the contact spring.

12. The contact part according to claim 11, wherein the multiple is a factor of 3 to 10.

13. The contact part according to claim 7, wherein the profile is symmetrical with respect to the axis.

14. The contact part according to claim 13, wherein the height of the profile is a multiple of the thickness of the contact tab, the multiple being a factor of 2 to 4.

15. The contact part according to claim 13, wherein the profile is arranged substantially between the first and second protrusions.

16. The contact part according to claim 1, wherein the sleeve comprises positively interlocking side edges.

17. The contact part according to claim 16, wherein the interlocking side edges are formed as a complementary meander.

18. A contact part for high-current plug connections in a vehicle, the contact part comprising:

a sleeve defining a receiving space to accommodate a plug-in contact, the sleeve being closed peripherally and comprising an upper side, a lower side, an open front side, and an open back side;

a contact spring secured to an inside of the sleeve at the upper side, the contact spring comprising a first protrusion, a second protrusion, and an intermediate section between the first and second protrusions; and a plate-shaped contact tab attached to the sleeve at the lower side so as to form the receiving space between the contact tab and the contact spring, the contact tab comprising a profile protruding towards the contact spring, the profile having a flat portion extending in the intermediate section of the contact spring.

19. The contact part according to claim 18, wherein:

the protrusions are symmetrical with respect to an axis perpendicular to the lower side; and the profile is symmetrical with respect to the axis.

20. The contact part according to claim 18, wherein:

the sleeve comprises a first tab arranged at the front side of the sleeve and a second tab arranged at the back side of the sleeve;

the contact spring is suspended in the sleeve from the tabs;

a first end of the contact spring is coupled to the first tab; and a second end of the contact spring is coupled to the second tab.

* * * * *